US009371686B2

(12) United States Patent
LaGarde

(10) Patent No.: US 9,371,686 B2
(45) Date of Patent: Jun. 21, 2016

(54) ACTUATOR FOR DRIVING A BLIND WITH ADJUSTABLE SLATS AND BLIND COMPRISING SUCH AN ACTUATOR

(71) Applicant: SOMFY SAS, Cluses (FR)

(72) Inventor: Eric LaGarde, Sallanches (FR)

(73) Assignee: SOMFY SAS, Cluses (FR)

( * ) Notice: Subject to any disclaimer, the term of this patent is extended or adjusted under 35 U.S.C. 154(b) by 0 days.

(21) Appl. No.: 14/771,722

(22) PCT Filed: Mar. 4, 2014

(86) PCT No.: PCT/EP2014/054157

§ 371 (c)(1),
(2) Date: Aug. 31, 2015

(87) PCT Pub. No.: WO2014/135525

PCT Pub. Date: Sep. 12, 2014

(65) Prior Publication Data

US 2016/0010388 A1 Jan. 14, 2016

(30) Foreign Application Priority Data

Mar. 5, 2013 (FR) ..... 13 51947

(51) Int. Cl.

| | |
|---|---|
| ***E06B 9/322*** | (2006.01) |
| ***E06B 9/304*** | (2006.01) |
| ***E06B 9/323*** | (2006.01) |

(Continued)

(52) U.S. Cl.

CPC . *E06B 9/322* (2013.01); *E06B 9/26* (2013.01); *E06B 9/30* (2013.01); *E06B 9/304* (2013.01); *E06B 9/323* (2013.01); *E06B 9/384* (2013.01); *E06B 2009/2622* (2013.01); *E06B 2009/3222* (2013.01)

(58) Field of Classification Search

USPC ..... 160/168.1 P, 176.1 P, DIG. 17, 115, 107, 160/188

IPC ..... E06B 9/322,2009/285, 2009/3222

See application file for complete search history.

(56) References Cited

U.S. PATENT DOCUMENTS

| | | | | | |
|---|---|---|---|---|---|
| 3,468,360 | A * | 9/1969 | Payne | ..... | E06B 9/367 160/172 R |
| 3,809,143 | A * | 5/1974 | Ipekgil | ..... | E06B 9/322 160/168.1 P |
| 4,096,903 | A * | 6/1978 | Ringle, III | ..... | E06B 9/322 160/107 |

(Continued)

FOREIGN PATENT DOCUMENTS

| | | | |
|---|---|---|---|
| CH | 691 131 | A5 | 4/2001 |
| FR | 2 957 966 | A1 | 9/2011 |
| WO | 2012/037447 | A2 | 3/2012 |

OTHER PUBLICATIONS

International Search Report, dated Apr. 24, 2014, from corresponding PCT application.

*Primary Examiner* — David Purol

(74) *Attorney, Agent, or Firm* — Young & Thompson

(57) ABSTRACT

An actuator (2) for driving a blind with adjustable slats, the actuator including a housing (20) inside which a motor (22) is installed, the motor driving a first output shaft (21) that projects on either side of the housing (20), characterised in that the actuator further includes a second output shaft (23) of which the axis of rotation (X23) is parallel to and not coinciding with that of the first output shaft (21) and controlled coupling elements (26) making it possible to selectively transmit a rotational movement from the first output shaft (21) to the second output shaft (23), and in that the second output shaft (23) projects on either side of the housing (20).

10 Claims, 2 Drawing Sheets

Figure 1:
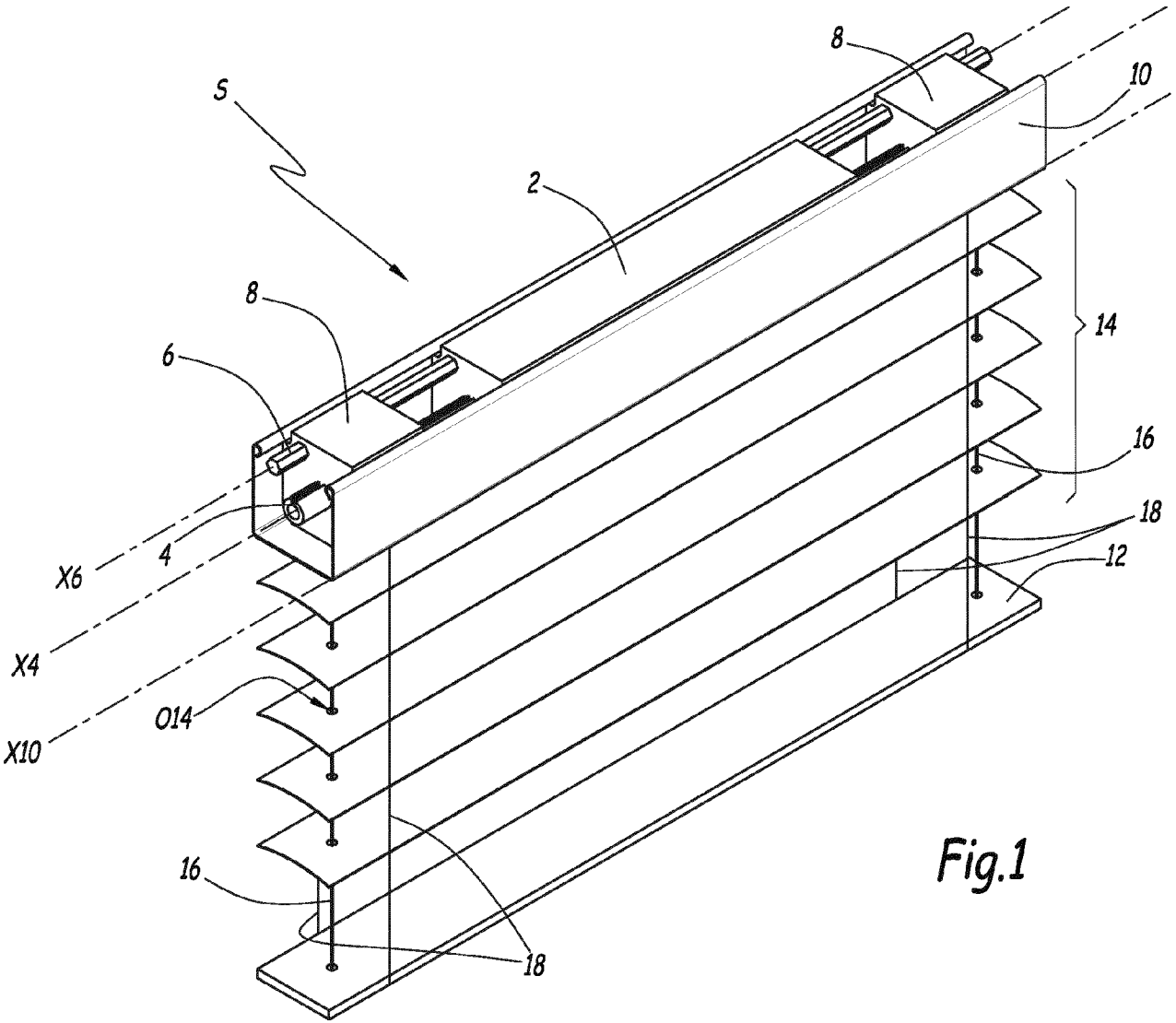

(51) Int. Cl.

| | |
|---|---|
| ***E06B 9/26*** | (2006.01) |
| ***E06B 9/30*** | (2006.01) |
| ***E06B 9/384*** | (2006.01) |
| *E06B 9/262* | (2006.01) |

(56) References Cited

U.S. PATENT DOCUMENTS 5,062,464 A * 11/1991 Peterson ..... E06B 3/94 160/138
5,511,601 A * 4/1996 Worthington ..... E06B 9/32 160/176.1 P
6,837,295 B2 * 1/2005 Wang ..... E06B 9/264 160/107
7,040,374 B2 * 5/2006 Wen ..... E06B 9/304 160/168.1 P
7,128,122 B2 * 10/2006 Lin ..... E06B 9/324 160/168.1 P
2008/0262637 A1 10/2008 Dorrough
2013/0001347 A1 1/2013 LaGarde et al.

* cited by examiner

ACTUATOR FOR DRIVING A BLIND WITH ADJUSTABLE SLATS AND BLIND COMPRISING SUCH AN ACTUATOR

The present invention relates to an actuator for driving a blind with adjustable slats. The invention is therefore applicable in the field of Venetian blinds positioned inside or outside buildings, for sun protection.

In a known manner in Venetian blinds, a first reel makes it possible to raise or lower the slats of the blind, and a second reel or pulley is used to orient the slats, the orientation of the slats making it possible to adjust the brightness inside the room. The first reel acts on an elevation cord, attached to a load bar, and the second reel acts on an orientation cord connected to the slats. The first and second reels are positioned in a shared tipper, driven by an output shaft of an actuator of the blind. During a rotation of the output shaft, both reels are therefore rotated. When the slats are oriented in an extreme position, i.e., completely closed, the orientation cord begins to slip on the second reel. Consequently, when the operator lowers the blind, the slats of the blind are all closed. The person is then in the shade as long as the slats have not been reoriented, manually or automatically, once the blind is lowered. The coupling between the winding function of the slats and the orientation function of the slats therefore creates discomfort in terms of use. Solutions to these problems are known, in particular through more developed tippers, in particular comprising an angular member that makes it possible to set a shaft in rotation in parallel and to act more independently on the orientation of the slats. This angular member is for example a gear or a spring friction system. Thus, when the operator begins to fold or unwind the blind, the angular member device is activated and the slats are oriented. This requires designing complex and expensive tippers, including an angular member device, that do not necessarily adapt to the actuators on the market.

In order to offset these drawbacks, it is possible to consider using blinds including two motors each powering a different driveshaft, i.e., a driveshaft dedicated to unwinding the blind and a driveshaft dedicated to the orientation of the slats. However, this type of blind would be very heavy and not very compact, since it would incorporate an additional motor and would add bulk at the horizontal box. This would therefore prevent adding components in the horizontal box and would limit the addition of new functionalities for the blind.

The invention more particularly intends to resolve these drawbacks by proposing an actuator that makes the blind more compact and more ergonomic.

To that end, the invention relates to an actuator for driving a blind with adjustable slats, said actuator comprising a housing inside which a motor is installed, said motor driving a first output shaft that projects on both sides of the housing. The actuator further comprises a second output shaft of which the axis of rotation is parallel to and not coinciding with that of the first output shaft and controlled coupling means making it possible to selectively transmit a rotational movement from the first output shaft to the second output shaft. The second output shaft projects on both sides of the housing.

Owing to the invention, it is possible to separate the function related to adjusting the height of the blind and the function related to orienting its slats. Thus, it is possible to lower or raise the blind by locking the orientation of the slats. Furthermore, the integration of uncoupling means into the actuator makes it more compact and adaptable to any type of Venetian blind. The installation itself is made easier, since all of the electrically controllable elements are found near one another, in the housing of the actuator. They can be controlled by a same control unit.

According to advantageous but optional aspects of the invention, an actuator may incorporate one or more of the following features, in any technically allowable combination:

- The actuator comprises an electronic control unit for the coupling means.
- The coupling means and the electronic control unit are positioned inside a housing.
- The motor is a dual output motor, the two outputs jointly forming the first output shaft of the actuator.
- The motor rotates a shaft that transmits, by means of a first gear, a rotational movement to the first output shaft of the actuator.
- The coupling means comprise a second gear and the second gear comprises an electromagnetically controlled clutch.
- The first gear comprises an electromagnetically controlled clutch making it possible to control the rotation of the first output shaft.

The invention also relates to a blind comprising a horizontal box supporting at least two tippers and an actuator, the actuator being positioned between two tippers, and a set of multidirectional slats. The actuator is of the type previously defined.

According to advantageous but optional aspects of the invention, a blind may incorporate one or more of the following features, in any technically allowable combination:

- The first output shaft is secured to a first driveshaft of the blind and the second output shaft is secured to a second driveshaft of the blind.
- The first driveshaft and the second driveshaft each drive at least one reel integrated into one of the tippers of the blind, those tippers being positioned on both sides of the actuator.

Figure 2:
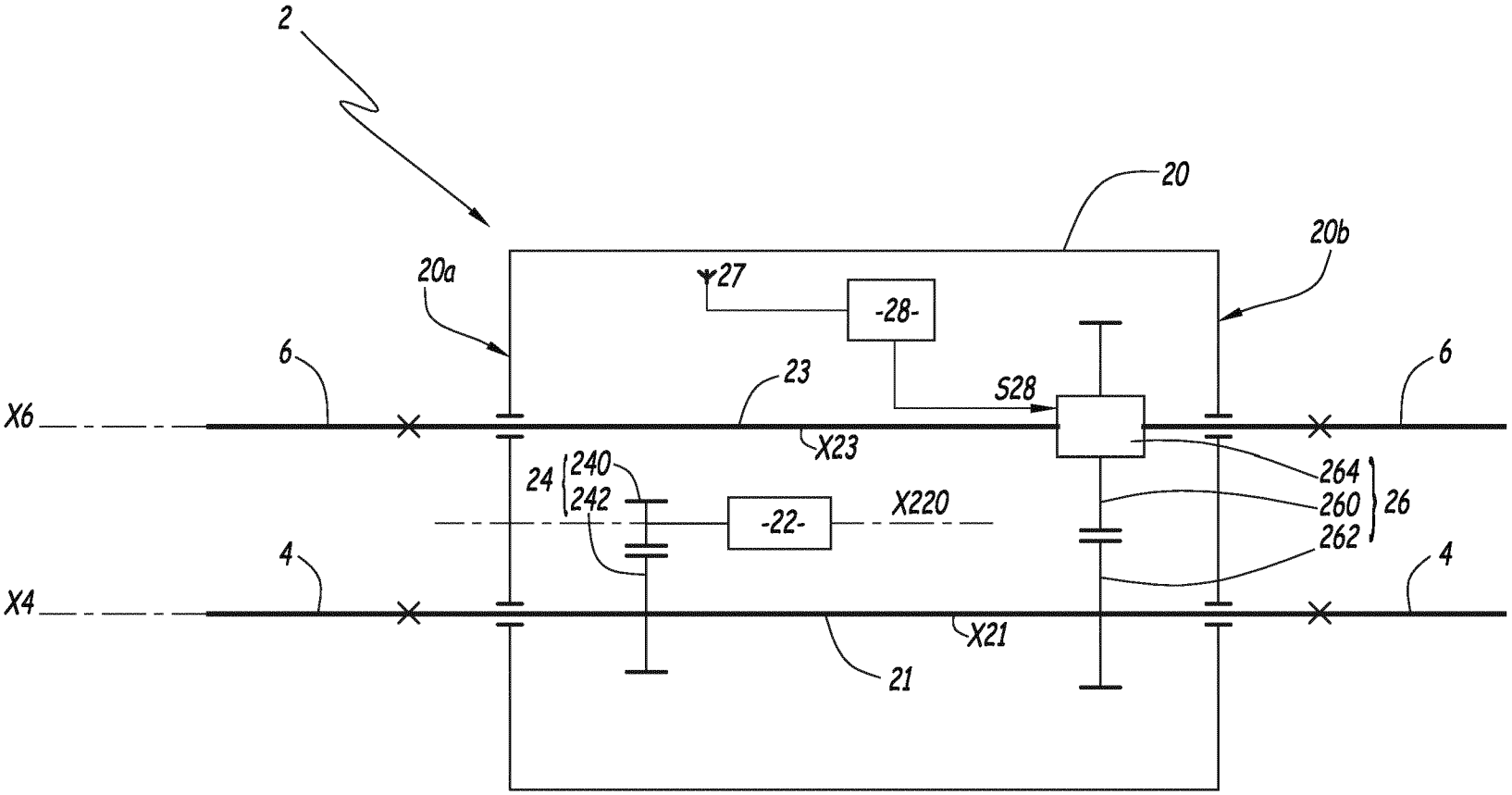

The invention will be better understood, and other advantages thereof will appear more clearly, in light of the following description of one embodiment of an actuator and a blind according to its principle, provided solely as an example and done in reference to the appended drawings, in which:

- FIG. 1 is a perspective view of a blind according to the invention,
- FIG. 2 is a diagram illustrating the operation of an actuator according to the invention belonging to the blind of FIG. 1.

FIG. 1 shows a blind S according to the invention. In its upper part, the blind S comprises a horizontal box 10 with a U-shaped section and that extends along a longitudinal axis X10. Below the horizontal box 10, several slats 14 are positioned at regular intervals, only some of which are shown in FIG. 1. A load bar 12 is positioned at the lower end of the blind, making it possible to raise or lower the blind. To that end, the load bar 12 is connected, using cords 16, to one or several first reels situated at the horizontal box 10. In the present case, the first reels are situated inside two tippers 8 that are each positioned at one end of the horizontal box 10, those reels not being shown in the figures. In order to access the load bar 12, the cords 16 cross through the slats 14 in orifices O14 and their lower end is fastened to the load bar 12.

Similarly, the blind S comprises two cords 18 that are attached to each of the slats 12 and that are each wound around a second reel also positioned inside one of the tippers 8. The cords 18 in fact form a loop engaged with the second reel serving as a pulley. By rotation, the second reel drives the movement of the cords 18, thus making it possible to orient the slats to adjust the brightness in the room. When the slats reach the closed position, the cord 18 slips on the pulley.

The first and second reels are driven, at the tippers 8, by driveshafts 4 and 6, respectively. The driveshafts 4 and 6 are positioned parallel to one another along the box 10, i.e., an axis of rotation X4 of the first driveshaft 4 is parallel to an axis of rotation X6 of the second rotation shaft 6 and the axis X10, without being combined.

Each tipper 8 is globally parallelepiped-shaped with a cross-section complementary to that of the horizontal box 10 and is crossed through by two driveshafts 4 and 6. An actuator 2 is positioned between the two tippers 8.

The actuator 2 is globally parallelepiped-shaped and includes a cross-section complementary to that of the horizontal box 10. This allows easier integration of the actuator 2 into the box 10.

As shown by FIG. 2, the actuator 2 comprises a housing 20, for example a watertight housing, from which a first output shaft 21 and a second output shaft 23 exit on a first side face 20*a* that is the face of the housing 20 situated on the left in FIG. 2. The two output shafts 21 and 23 also exit on the second side face 20*b* that is the face of the housing 20 opposite the face 20*a* and is situated on the right in FIG. 2. The output shafts 21 and 23 have an axis of rotation X21 and X23, respectively, those axes of rotation X21 and X23 being parallel and not coinciding. The output shafts 21 and 23 are respectively guided relative to the housing 20, owing to guide means such as bearings or watertight rolling bearings, not shown in the figures. Furthermore, the output shafts 21 and 23 are able to drive the driveshafts 4 and 6, respectively, in rotation. In other words, the axes X21 coincides with the axis X4 and the axis X23 coincides with the axis X6. More specifically, the output shafts 21 and 23 are respectively secured to the driveshaft 4 and 6 by fitting of the driveshafts 21 and 23 in the driveshafts 4 and 6. To that end, the driveshafts 4 and 6 each comprise a hollow output sleeve, the hollow part of which is suitable for receiving the end of the corresponding output shaft. These settings are shown in FIG. 2 by crosses. To that end, the output shafts 21 and 23 axially project on both sides of the housing 20 of the actuator.

Thus, the output shafts 21 and 23 extend, by means of the driveshafts 4 and 6, to the two tippers 8.

Inside a housing 20, an electric motor 22 is positioned, with the understanding that it can also be a gear motor. The motor 22 comprises a single output shaft 220, an axis of rotation X220 of which is parallel to that of the output shafts 21 and 23 and which extends toward the first side face 20*a*. The motor 22 rotates a first pinion 240 engaged with a second pinion 242. The first pinion 240 and the second pinion 242 have outer toothings complementary to one another and together form a first gear 24. The second pinion 242 is secured in rotation with the first output shaft 21. Thus, the rotation of the motor 22 drives the rotation of the first output shaft 21.

On the same output shaft 21 and on the side of the side face 20*b*, a first pinion 262 is positioned secured in rotation with the first output shaft 21 and which cooperates with a second pinion 260. The second pinion 260 is connected to the second output shaft 23, the axis of rotation of which is parallel to and not coinciding with that of the first output shaft 21. The first pinion 262 has an outer toothing complementary to that of the second pinion 260. Together, they therefore form a second gear 26.

The second gear 26 differs from the first gear 24 inasmuch as it further comprises an electromagnetic clutch 264 that selectively connects the pinion 260 to the shaft 23. Consequently, the rotation of the second output shaft 23 is obtained selectively, i.e., in an uncoupled configuration where the electromagnetic clutch 264 is not active, the output shaft 23 not being set in rotation by the rotation of the first output shaft 21.

To that end, the actuator 2 comprises an electronic unit 28 for controlling the clutch 264 using an electric signal S28. In a known manner, the electronic control unit 28 receives an order from the operator. That order is for example emitted using a remote control (not shown) that transmits control signals in the form of radio waves to a receiver 27 comprising an antenna situated in the actuator 2. Based on the nature of the signal received by the receiver 27, the control unit 28 does or does not activate the electromagnetic clutch owing to the signal S28. The second output shaft 23 is secured in rotation with a serrated crown (not shown) and the second pinion 260 includes, inside, splines complementary to the toothings of that crown. When the clutch 264 is deactivated, the serrated crown is offset relative to the pinion 260 and along the axis X23. In the event the clutch 264 is activated, the crown moves by magnetization axially inside the pinion 260. The complementary nature of the toothings with respect to the splines involves the rotation of the second output shaft 23. The gear 26 therefore forms controlled coupling means between the first output shaft 21 and the second output shaft 23, and those coupling means are directly integrated into the actuator 2 and controlled by the user.

The first output shaft 21 drives the first driveshaft 4 and makes it possible to raise or lower the blind S, while the second output shaft 23 is secured to the second driveshaft 6 and makes it possible to orient the slats 14, in order to adjust the brightness in the room.

If the clutch is activated, the orientation of the slats is done simultaneously with the raising or lowering of the blind. Conversely, it is possible for the user to lower or raise the blind S with a fixed orientation of the slats 14. To that end, it is necessary to deactivate the electromagnetic clutch 264. The pinion 260 then rotates freely around the axis X23 without driving it. The orientation of the slats 14 is not modified during the adjustment of the height of the blind. Thus, starting from a configuration where the slats 14 are open, the slats of the blind are not closed before lowering the blind.

Furthermore, the reels situated at the driveshaft 6 include a slipping system that acts when the slats have arrived in a completely closed or completely open position. This slipping system therefore allows the driveshaft 6 to work as a free wheel. These slipping systems are for example of the same type as those previously described, implementing a loop of the cord on a reel of the pulley type.

The selective coupling between the raising/lowering function of the blind and the orientation function of the slats thereof means that an orientation movement of the slats of the blind is based on a raising or lowering movement of the apron. However, these raising or lowering movements of the apron are not very perceptible by user and do not create any discomfort. The use of a means for transmitting the rotational movement from the first output shaft 21 to the second output shaft 23 through a gear also means that the orientation of the slats 14 is done in the direction related to the movement of the blind. It is in fact the direction of rotation of the first output shaft 21 that determines the direction of rotation of the second output shaft 23 and, consequently, the direction of the orientation. However, orientation movements of the slats in both directions are possible.

In practice, the coupling between the first and second output shafts 21 and 23 should be activated before even setting the motor in rotation to avoid damaging the gear 26. In fact, during the adjustment of the height of the blind, an axial movement of the crown in the pinion 260 may cause poor engagement of the teeth of the crown in the splines of the pinion 260, since the pinion 260 is rotating. This would result in deterioration of the gear 26. Specific commands may thus be given to the receiver and/or understood by the receiver so as to differentiate a movement command from an orientation command of the slats.

The angular member function, making it possible to double the drive axes, is integrated into the actuator 2, which makes it possible to eliminate the use of specific tippers 8 and provides more flexibility regarding the adaptation of the actuator 2 on any blind. The various functions, such as receiving commands, controlling the coupling means and controlling the motor, managed by the control unit are therefore also integrated into the actuator, which simplifies the development and installation of the actuator.

In an alternative that is not shown, it is possible to use a number of tippers 8 strictly greater than two, the actuator being installed between two of the tippers.

In an alternative that is not shown, the motor is a dual output motor. The two output shafts of the motor then correspond to the first output shaft 21 of the actuator.

According to another alternative that is not shown, the coupling means between the first output shaft 21 and the second output shaft 23 differ from a gear, while being controlled by the user.

According to another alternative that is not shown, the driveshaft 4 and the first output shaft 21 are a single piece and the driveshaft 6 and the second output shaft 23 are a single piece.

The features of the embodiments and alternatives described above may be combined in order to create new embodiments.

The invention claimed is:

1. An actuator for driving a blind with adjustable slats, said actuator comprising a housing inside which a motor is installed driving a first output shaft that projects on both sides of the housing, a second output shaft of which the axis of rotation is parallel to and not coinciding with that of the first output shaft, the second output shaft projecting on both sides of the housing, and controlled coupling means making it possible to selectively transmit a rotational movement from the first output shaft to the second output shaft.

2. The actuator according to claim 1, wherein it comprises an electronic control unit for the coupling means.

3. The actuator according to claim 2, wherein the coupling means and the electronic control unit are positioned inside the housing.

4. The actuator according to claim 1, wherein the motor is a dual output motor, the two outputs of the dual output motor jointly forming the first output shaft of the actuator.

5. The actuator according to claim 1, wherein the motor drives a shaft that transmits, by means of a first gear, a rotational movement to the first output shaft of the actuator.

6. The actuator according to claim 1, wherein the coupling means comprise a second gear and wherein the second gear comprises an electromagnetically controlled clutch.

7. The actuator according to claim 5, wherein the first gear comprises an electromagnetically controlled clutch making it possible to control the rotation of the first output shaft.

8. A blind comprising a horizontal box supporting at least two tippers and an actuator, the actuator being positioned between two tippers, and a set of multidirectional slats, wherein the actuator is according to claim 1.

9. The blind according to claim 8, wherein the first output shaft is secured to a first driveshaft of the blind and the second output shaft is secured to a second driveshaft of the blind.

10. The blind according to claim 9, wherein the first driveshaft and the second driveshaft each drive at least one reel integrated into one of the tippers of the blind, those tippers being positioned on both sides of the actuator.

* * * * *